United States Patent [19]

Stift et al.

[11] 3,991,987

[45] Nov. 16, 1976

[54] ROTARY KILN AND HEARTH FURNACE

[75] Inventors: Kurt Stift; Helwig Vacek, both of Leoben, Austria

[73] Assignee: Vereinigte Osterreichische Eisen- und Stahlwerke- Alpine Montan Aktiengesellschaft, Vienna, Austria

[22] Filed: Feb. 19, 1975

[21] Appl. No.: 551,014

[30] Foreign Application Priority Data

Feb. 22, 1974 Austria ..... 1472/74

[52] U.S. Cl. ..... 266/163; 432/106; 432/115; 432/164

[51] Int. Cl.[2] ..... C21C 5/50; F27B 7/02

[58] Field of Search ..... 432/106, 115, 164; 266/36 P, 163

[56] References Cited

UNITED STATES PATENTS

| | | | |
|---|---|---|---|
| 1,782,423 | 11/1930 | Hornsey | 432/115 |
| 2,235,154 | 3/1941 | Jones | 266/36 P |
| 2,506,618 | 5/1950 | Sainderichin | 432/106 X |
| 3,295,930 | 1/1967 | Swanson et al. | 432/106 X |

FOREIGN PATENTS OR APPLICATIONS

| | | | |
|---|---|---|---|
| 299,719 | 4/1971 | U.S.S.R. | 432/106 |

*Primary Examiner*—John J. Camby
*Attorney, Agent, or Firm*—Cushman, Darby & Cushman

[57] ABSTRACT

A joint between a rotary kiln and a tiltable hearth furnace, characterized in that a part of the hearth furnace embraces the discharge end of the rotary kiln and the pivotal axis of the hearth furnace coincides with the axis of rotation of the rotary kiln at the joint between the rotary kiln and the hearth furnace.

4 Claims, 2 Drawing Figures

ROTARY KILN AND HEARTH FURNACE

This invention relates to a joint between a rotary kiln and a tiltable hearth furnace.

In the extraction of iron from iron ores it is known to reduce the latter in a rotary kiln by a treatment with added carbon and reducing flame gases and to use a hearth furnace to collect the reduced iron and to separate it by melting from the slag-forming gangue. In the known arrangements, the joint between the discharge end of the rotary kiln and the hearth furnace comprises a shaft, which opens through the arched roof of the hearth furnace, or a chute, which extends through a side wall of the hearth furnace. Depending on the design of that joint, the hearth furnace can be tilted only through a restricted angle in most cases or a poor seal is obtained. In all cases, the joint requires a separate part, which involves increased heat losses.

It is an object of the invention to avoid these disadvantages. The invention essentially resides in that a part of the hearth furnace embraces the discharge end of the rotary kiln and the pivotal axis of the hearth furnace coincides with the axis of rotation of the rotary kiln at the joint between the latter and the hearth furnace. As a result, the furnace chamber of the rotary kiln opens directly into the furnace chamber of the hearth furnace and the material discharged drops or slides directly onto the hearth of the hearth furnace and can be subjected to further processing there whereas heat losses are substantially avoided. A well-sealed joint is enabled because the axis of rotation of the rotary kiln and the pivotal axis of the hearth furnace coincide at the joint between the rotary kiln and the hearth furnace. In a preferred embodiment of the invention, the hearth furnace is tiltable about the axis of rotation of the rotary kiln so that the formation of a tight joint between the discharge end of the rotary kiln and the hearth furnace is facilitated. The arrangement is suitably such that the discharge end of the rotary kiln extends through a side wall of the hearth furnace. As a result, the material treated in the rotary kiln falls directly on the hearth without stressing the wall of the hearth furnace.

In cases in which the diameter of the rotary kiln is larger than the height of the normal side wall of the hearth furnace, it is another feature of the invention to raise the arched roof of the hearth furnace in the region in which the rotary kiln opens into the hearth furnace. This arrangement has the advantage that the diameter of the rotary kiln is not restricted to the usual height of the side wall of the hearth furnace.

Figure 2:
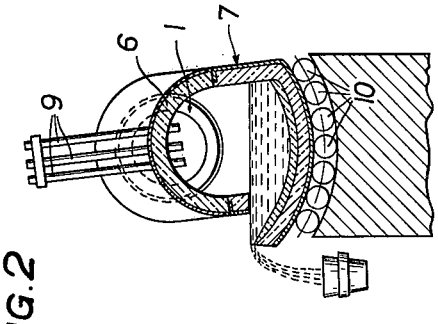
Figure 1:
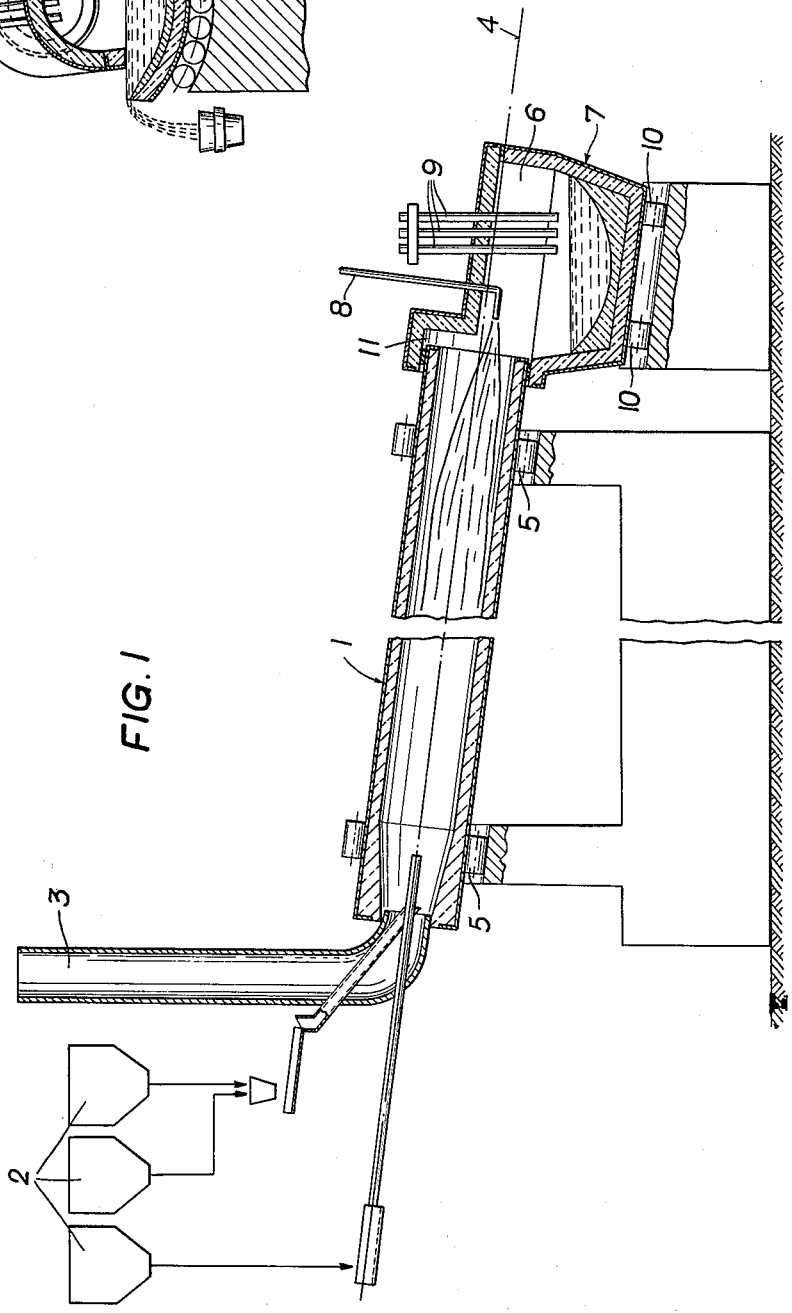

An embodiment of the invention is shown by way of example on the drawing, in which FIG. 1 is a longitudinal sectional view showing the two furnaces joined according to the invention and FIG. 2 is a transverse sectional view taken on a plane which extends through the hearth furnace at right angles to the axis of rotation and pivotal axis.

Bins 2 and feeding means for iron ore, fluxes and reducing agents as well as a chimney 3 are provided at the charging end of the rotary kiln 1. The latter rotates in contact with rollers 5, which are arranged on a circle which is centered on the axis of rotation 4 of the kiln. The hearth furnace 7 consists of an electric furnace and has an arched roof 6, which contains a burner 8 for heating the rotary kiln 1 and electrodes 9 for heating the hearth furnace 7. The hearth furnace is provided with skids, not shown, which rest on rollers 10, which are also arranged on a circle that is centered on the axis of rotation 4 so that the pivotal axis of the hearth furnace 7 coincides with the axis of rotation 4 of the rotary kiln 1. As a result, the hearth furnace 7 can be directly connected to the discharge end of the rotary kiln and a simple seal may be used for this purpose, if desired. To avoid an excessively large distance from the arched roof 6 of the hearth furnace 7 to the surface of the molten bath, the arched roof 6 is raised in the region 11 in which the rotary kiln 1 opens into the hearth furnace.

FIG. 2 shows the hearth furnace 7 in a tilted position for pouring the collected metal which is to be processed further, e.g., in an oxygen top-blowing converter, not shown, in which the iron is refined by a treatment with oxygen blown onto the surface of the bath.

In the embodiment shown on the drawing the pivotal axis of the hearth furnace 7 coincides with the axis of rotation of the rotary kiln so that there is a common axis of rotation and pivotal axis 4. Because the axis of rotation of the rotary kiln 1 is inclined, the hearth furnace 7 must also be tiltable about an inclined axis. It is essential that the pivotal axis of the hearth furnace 7 coincides with the axis of rotation of the rotary kiln 1 at the joint between the rotary kiln 1 and the hearth furnace 7. If the discharge end of the rotary kiln 1 is spherical, this requirement can also be met if the hearth furnace 7 is tiltable about a horizontal pivotal axis.

We claim:

1. A furnace construction comprising: an inclined rotary kiln mounted for rotation about its longitudinal axis, said kiln defining an elongated furnace chamber and having an upper end for receiving material to be heated in the chamber and a lower end from which the material is discharged from the chamber by sliding movement, upon rotation of the kiln; a hearth furnace having a furnace chamber; a joint between the lower end of the kiln and the hearth furnace, the lower end of the kiln passing through the joint and into a part of the hearth furnace so that the kiln chamber opens into the hearth chamber to discharge material directly into the hearth chamber; and means mounting the hearth furnace for tilting movement, independent of rotation of the kiln, about an axis of rotation which is the same as the axis of rotation of the kiln.

2. A furnace construction as in claim 1 wherein the hearth furnace includes an upright side wall and wherein the lower end of the kiln extends through said side wall.

3. A furnace construction as in claim 1 wherein the hearth furnace includes an arched roof forming the top of the hearth chamber, said arched roof having a first portion which overlies the material in the hearth chamber and a second portion at a higher elevation which overlies the lower end of the kiln.

4. A furnace construction comprising: an inclined rotary kiln mounted for rotation about its longitudinal axis said kiln having an open lower end from which material is discharged during rotation of the kiln; a hearth furnace having walls defining a hearth furnace chamber, one of said walls having an opening therein through which the lower end of the kiln extends so as to discharge material directly into the hearth chamber; a sliding annular seal between the lower end of the kiln and said one wall of the hearth furnace for permitting relative rotation between the kiln and the hearth furnace; and means mounting the hearth furnace for tilting movement, independent of rotation of the kiln, about an axis of rotation which is the same as the rotation axis of the kiln.

* * * * *